US010902828B1

(12) United States Patent
Baumbaugh

(10) Patent No.: US 10,902,828 B1
(45) Date of Patent: Jan. 26, 2021

(54) AMPLIFIER EQUIPMENT MOUNTING SYSTEM

(71) Applicant: Keith Baumbaugh, Selma, NC (US)

(72) Inventor: Keith Baumbaugh, Selma, NC (US)

( * ) Notice: Subject to any disclaimer, the term of this patent is extended or adjusted under 35 U.S.C. 154(b) by 0 days.

(21) Appl. No.: 16/894,493

(22) Filed: Jun. 5, 2020

Related U.S. Application Data

(60) Provisional application No. 63/022,497, filed on May 10, 2020, provisional application No. 63/015,569, filed on Apr. 26, 2020.

(51) Int. Cl.
*G10G 5/00* (2006.01)
*A47B 57/54* (2006.01)

(52) U.S. Cl.
CPC ..... *G10G 5/00* (2013.01); *A47B 57/54* (2013.01)

(58) Field of Classification Search
CPC . A47B 96/065; A47B 2230/08; A47B 96/063; A47B 57/44; A47B 57/545; A47B 57/265; A47B 91/022; A47B 57/26; A47B 57/54; A47B 81/00; A47B 91/02; A47B 96/06; F16M 11/041; F16M 13/02; G10G 5/00; G10G 5/005; G10D 3/00
USPC ..... 248/443, 451, 312.1, 316.1, 121; 211/85.6; 84/327, 453, 421
See application file for complete search history.

(56) References Cited

U.S. PATENT DOCUMENTS 160,044 A * 2/1875 Wilson ..... A47B 23/042 248/451
200,262 A * 2/1878 Auria ..... A47B 23/004 248/443
1,045,123 A * 11/1912 Clisby ..... D06F 79/02 248/117.7
1,170,684 A * 2/1916 Schlieckert ..... F16B 1/0057 248/227.3
1,330,814 A * 2/1920 Meyer ..... G10D 13/00 248/226.11
1,661,805 A * 3/1928 Lentaty ..... G10G 5/00 248/127
2,099,254 A * 11/1937 Ballman ..... A01K 97/10 248/515
2,452,116 A * 10/1948 Felton ..... A01K 97/10 248/514
3,193,325 A * 7/1965 Wenger ..... G10G 5/00 297/186

(Continued)

*Primary Examiner* — Jonathan Liu
*Assistant Examiner* — Devin K Barnett
(74) *Attorney, Agent, or Firm* — Dogwood Patent and Trademark Law; Ashley D. Johnson

(57) ABSTRACT

The presently disclosed subject matter is generally directed to a mounting system that securely stores an instrument (e.g., a guitar) on either side of a support, such as an amplifier and/or speaker. The disclosed system includes a main bar that directly contacts a top surface, such as a speaker cabinet. The main bar comprises a pair of side arms that support mounts. In this way, a pair of instruments can be simultaneously suspended by the headstock on either side of the support. The system also includes a support bar operably attached via connectors to the main bar for the releasable attachment of a microphone. The support bar comprises at least one foot assembly that locks the system in place under the lip of the top support surface. Advantageously, the system securely retains an instrument on either side of a support, keeping it safely secured and out of the way until needed by the user.

19 Claims, 20 Drawing Sheets

(56) References Cited

U.S. PATENT DOCUMENTS 3,664,224 A * 5/1972 Campagna, Jr. ..... G10H 3/18 84/327
4,084,778 A * 4/1978 Dominguez ..... G10G 5/00 248/300
4,448,384 A * 5/1984 Jones, Jr. ..... A47B 23/004 248/443
4,991,809 A * 2/1991 Harkey ..... G10G 5/00 248/229.12
5,313,866 A * 5/1994 Smith ..... G10G 5/00 248/121
5,490,599 A * 2/1996 Tohidi ..... H04R 1/406 211/171
5,573,158 A * 11/1996 Penn ..... G10G 5/00 224/265
5,645,256 A * 7/1997 Thomas, II ..... G10G 5/00 248/222.11
5,725,111 A * 3/1998 Choi ..... D06F 57/12 211/104
5,804,747 A * 9/1998 Chen ..... F16M 11/14 248/443
6,127,612 A * 10/2000 Yu ..... G10G 5/00 84/327
6,610,916 B1 * 8/2003 Torrez ..... F16M 13/02 84/421
6,800,798 B2 * 10/2004 Hsieh ..... G10G 5/00 84/327
7,458,555 B2 * 12/2008 Mastropaolo ..... A47B 23/02 248/160
7,464,910 B1 * 12/2008 St. Germain ..... G10G 5/00 211/85.6
7,547,835 B1 * 6/2009 Mayor ..... G10G 5/00 84/327
D648,572 S * 11/2011 Werner ..... D6/682.4
8,181,922 B2 * 5/2012 Dennison ..... G10H 1/32 248/175
8,511,240 B1 * 8/2013 Strock ..... A47B 96/065 108/98
9,601,094 B2 * 3/2017 Bradfield ..... G10G 5/00
9,899,011 B2 * 2/2018 Gallo ..... G10G 5/00
2005/0000348 A1 * 1/2005 Workman ..... G10G 5/00 84/327
2008/0028913 A1 * 2/2008 Driscoll ..... G10G 5/00 84/327
2008/0060498 A1 * 3/2008 Samu ..... G10G 5/00 84/327
2008/0163739 A1 * 7/2008 Mori ..... G10D 13/02 84/421
2008/0179266 A1 * 7/2008 Mori ..... G10D 13/28 211/85.6
2010/0301188 A1 * 12/2010 Schimelfenyg ..... F16M 11/041 248/447.2
2011/0101192 A1 * 5/2011 Lee ..... F16M 11/041 248/346.03
2011/0219938 A1 * 9/2011 McBain ..... G10D 13/28 84/421
2011/0253655 A1 * 10/2011 Mone ..... G10G 5/00 211/85.6
2012/0138558 A1 * 6/2012 Marks ..... G10D 13/00 211/85.6
2014/0175241 A1 * 6/2014 Yang ..... G10G 5/00 248/274.1
2014/0217872 A1 * 8/2014 Blanco ..... G10D 3/00 312/237
2015/0122960 A1 * 5/2015 Eward ..... G10G 5/00 248/231.91
2015/0129523 A1 * 5/2015 Cortina ..... F16B 2/10 211/85.6
2016/0051046 A1 * 2/2016 Sassman ..... A47B 81/00 211/85.6
2016/0111070 A1 * 4/2016 Hankins ..... G10G 5/00 84/327
2017/0309262 A1 * 10/2017 Walker ..... F16M 11/28
2018/0151157 A1 * 5/2018 Ng ..... F16M 11/22
2020/0294477 A1 * 9/2020 Saleh ..... F16M 11/041

* cited by examiner

AMPLIFIER EQUIPMENT MOUNTING SYSTEM

CROSS-REFERENCE TO RELATED APPLICATIONS

This application claims priority to U.S. Provisional Patent Application Nos. 63/022,497 filed May 10, 2020 and 63/015,569 filed Apr. 26, 2020, the entire contents of which are hereby incorporated by reference in their entireties.

TECHNICAL FIELD

The presently disclosed subject matter is generally directed to an amplifier equipment mounting system.

BACKGROUND

It is common for musicians to rehearse, record, and perform in an area crowded with equipment. For example, lighting, microphone stands, wiring, as well as larger equipment such as amplifiers and combination amplifiers are frequently present. During rehearsals and performances, musicians find it necessary to periodically set their instruments aside, such as when playing a different instrument, taking a break, or to complete another activity. It is desirable to rest an instrument in a place that is protected from possible damage to the instrument, yet conveniently accessible when needed. While freestanding guitar stands are designed to be as compact as possible, the floor space available to the performer is reduced by the area encompassed by conventional stands. In addition, traditional guitar stands are unstable and easily tip over, risking damage to the instrument. It would therefore be beneficial to provide a guitar stand with an improved resistance against tipping over in the event of accidental contact. There is also a need for a stand that occupies minimal floor space and holds the guitar without damaging the instrument or affecting tuning. It would further be beneficial if the device allowed the guitar to be easily and conveniently released when the instrument is needed.

SUMMARY

In some embodiments, the presently disclosed subject matter is directed to an instrument mounting system. The mounting system comprises an elongate main bar comprising a first end and a second end; a first side arm attached to the first end of the main bar and a second side arm attached to the second end of the main bar, wherein each side arm comprises a mount for securing the instrument; an elongate support bar comprising a first end and a second end, wherein the support bar is operatively attached to the main bar by one or more rounded connectors; and a foot assembly positioned at each end of the support bar, wherein the foot assembly comprises a gripping foot.

In some embodiments, the mounting system further comprises a microphone assembly releasably attached to the support bar.

In some embodiments, the instrument is selected from an acoustic guitar, bass guitar, electric guitar, banjo, mandolin, violin, cello, viola, or combinations thereof.

In some embodiments, the mount is configured to secure the instrument by the headstock.

In some embodiments, the main bar and the support bar are about parallel relative to each other.

In some embodiments, a bottom surface of the main bar comprises padding.

In some embodiments, the side arm can be attached to the main bar at any angle desired by a user.

In some embodiments, the side arm includes at least one aperture.

In some embodiments, the mount comprises a pair of upturned prongs.

In some embodiments, the mount comprises an internal diameter that is sized to accommodate a guitar neck but not a guitar headstock.

In some embodiments, the gripping foot comprises a swivel foot with an adjustable angle, position, length, or combinations thereof.

In some embodiments, the presently disclosed subject matter is directed to a method of mounting an instrument. Particularly, the method comprises positioning the main bar of the disclosed instrument mounting system on a top surface of a support, such that the support foot assembly contacts an upper lip of the support; positioning a second support on a top surface of the first support, such that the main bar is positioned in between the first and second supports; and removably attaching at least one instrument comprising a neck and headstock to a first mount, wherein the headstock is cradled by the mount prongs on a side face of the support.

In some embodiments, the support is a speaker cabinet.

In some embodiments, the second support is an amplifier.

In some embodiments, the method further comprises releasably attaching a microphone assembly to the support bar.

In some embodiments, the instrument is selected from an acoustic guitar, bass guitar, electric guitar, banjo, mandolin, violin, cello, viola, or combinations thereof.

In some embodiments, the main bar and the support bar are about parallel relative to each other.

In some embodiments, a bottom surface of the main bar comprises padding.

In some embodiments, the mount comprises an internal diameter that is sized to accommodate an instrument neck but not an instrument headstock.

In some embodiments, the foot assembly comprises a swivel foot with an adjustable angle, position, length, or combinations thereof.

DETAILED DESCRIPTION

Figure 1A:
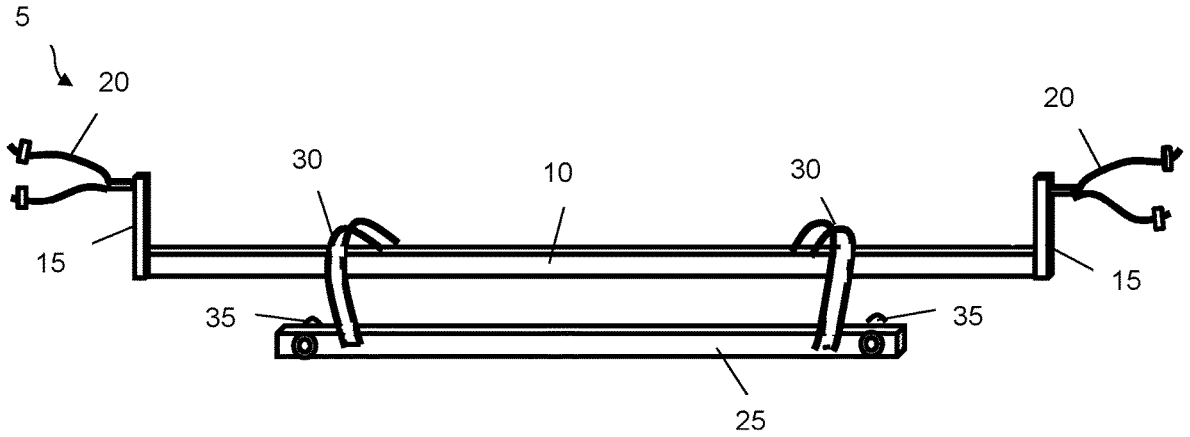
FIG. 1*a* is a perspective view of a mounting system in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
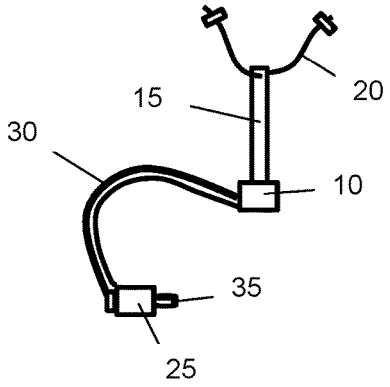
FIG. 1*b* is a side plan view of the mounting system of FIG. 1*a*.

The presently disclosed subject matter is generally directed to a mounting system that securely stores a guitar (or other item) on either side of a support, such as an amplifier, speaker, box, table, and the like. The disclosed system can be used to support an instrument (e.g., a guitar) that is not in use, functioning as a stand in some embodiments. As shown in FIGS. 1*a* and 1*b*, system 5 includes main bar 10 that directly contacts a top surface of a support (such as a speaker cabinet or amplifier), as described in more detail below. The main bar comprises a pair of side arms 15 that support guitar mounts 20. In this way, a pair of guitars can be simultaneously suspended by the headstock on either side of the support. The device also includes support bar 25 operably attached via connectors 30 to the main bar for the releasable attachment of a microphone. The support bar comprises at least one foot assembly 35 that locks the device in place under the lip of the support top surface. Advantageously, system 5 securely retains a guitar on either side of a support, keeping the guitars safely secured and out of the way until needed by the user.

The term "guitar" as used herein can refer to any musical instrument having an elongated neck and instrument body located at the end of the elongated neck. Suitable guitars can include (but are not limited to) acoustic guitars, bass guitars, electric guitars, banjos, mandolins, guitar-style keyboards, violins, cellos, violas, etc. It should also be appreciated that the disclosed mounting system is not limited to instruments and can be used to house any suitable item.

Figure 2A:
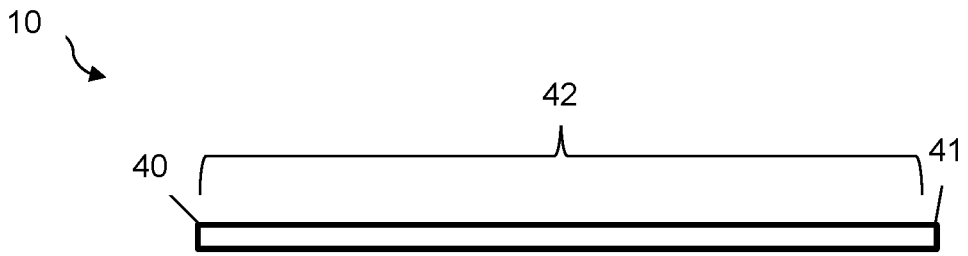
FIG. 2*a* is a front plan view of a system main bar in accordance with some embodiments of the presently disclosed subject matter.

FIG. 2*a* illustrates one embodiment of elongate main bar 10. The term "bar" refers to any rod, pole, rail, or other device that can be used to support a guitar as described herein. In some embodiments, the main bar can be about horizontal in configuration. As shown, the main bar includes first end 40, second end 41, and length 42 that spans the two ends.

The main bar can have any desired length, such as about 10-40 inches (e.g., at least/no more than about 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 inches). However, the presently disclosed subject matter is not limited and the main bar can have a length greater or less than the range given herein.

Figure 2B:
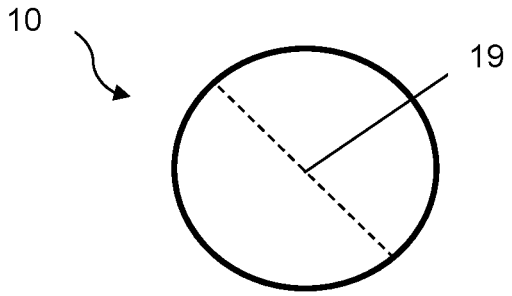
FIG. 2*b* is a cross sectional view of a system main bar in accordance with some embodiments of the presently disclosed subject matter.

Main bar 10 can further have any desired diameter. The term "diameter" refers to the distance of a straight-line segment 19 passing through the center of a body, as shown in FIG. 2*b*. The main support and/or braces can have diameter of about 0.1-2 inches. Thus, the main bar can have a diameter of at least about (or no more than about) 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2 inches. However, the presently disclosed subject matter is not limited and the main bar can include a diameter greater or less than the range given above.

Figure 2C:
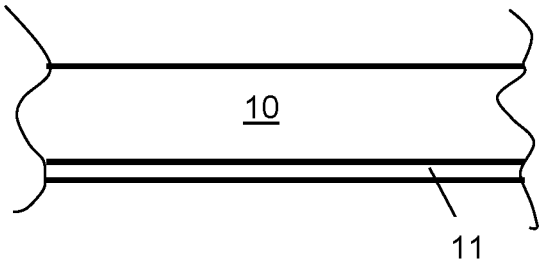
FIG. 2*c* is a fragmentary front plan view of system main bar in accordance with some embodiments of the presently disclosed subject matter.

In some embodiments, at least one surface (e.g., a bottom surface) of main bar 10 can include padding 11, as shown in FIG. 2*c*. In some embodiment, the entire exterior surface of the main bar can include padding. The term "padding" refers to a material that serves to provide cushioning to an object. The padding can help prevent scratches when the mounting system is assembled and the main bar rests on a top surface of a support (e.g., the top surface of speaker cabinet or an amplifier). Suitable cushioning materials can include (but are not limited to) foam, rubber, cork, elastomeric plastic, cloth, felt, and the like. The cushioning can take any form, such as strips, pads, or individual blocks of material. Padding 11 can be attached to the main bar using any technique, such as the use of adhesive, heat seal, and/or mechanical elements (e.g., clips). It should be appreciated that padding 11 is optional.

Figure 3A:
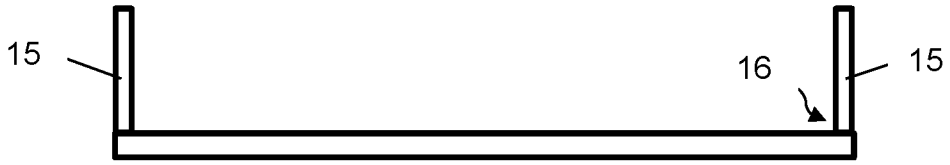
FIG. 3*a* is a front plan view of a main bar comprising side arms in accordance with some embodiments of the presently disclosed subject matter.
Figure 3B:
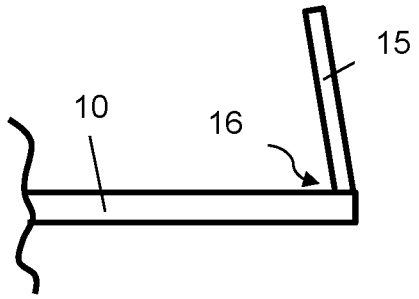
FIGS. 3*b* and 3*c* are fragmentary front plan views illustrating angled side arms in accordance with some embodiments of the presently disclosed subject matter.
Figure 3C:
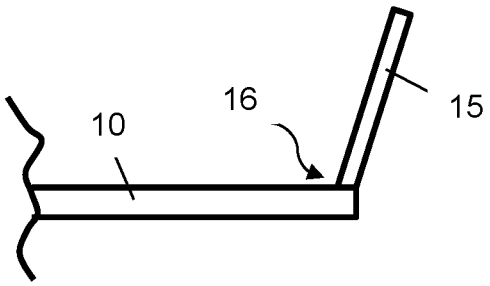

Each end of main bar 10 comprises side arm 15 that cooperates with mounts for holding a guitar, as described below. In some embodiments, a side arm is configured at each end 40, 41 of the main bar. In other embodiments, the side arms can be configured adjacent to the main bar ends (e.g., about 0.1-5 inches from ends 40, 41). FIG. 3*a* illustrates one embodiment of main bar 10 comprising side arms 15 positioned at first and second ends of the main bar. Each side arm includes one end that attaches to the main bar and an opposing end that cooperates with an instrument (e.g., guitar) mount. Each side arm attaches to the main bar at angle 16. In some embodiments, angle 16 can be about 90 degrees, as shown in FIG. 3*a*. However, the disclosed system also includes embodiments wherein angle 16 is acute or obtuse as shown in FIGS. 3*b* and 3*c*. The term "acute" refers to an angle of less than 90 degrees. The term "obtuse" refers to an angle greater than 90 degrees. Thus, angle 16 can be at least/no more than about 45, 50, 55, 60, 65, 70, 75, 80, 85, 90, 95, 100, 105, 110, 115, 120, 125, 130, 135, 140, 145, 150, 155, or 160 degrees. In some embodiments, angle 16 can be adjustable as desired by the user, such as through the use a locking hinge or any other mechanism.

In some embodiments, side arms 15 are permanently attached to each end of main bar 10, such as through the use of adhesives, welding, and the like. Alternatively, the side arms can be removably attached to the main bar through pressure fit, snap fit, screw threads, magnets, mechanical attachment (e.g., screws, bolts, clips, snaps), and the like to allow the stand to be easily disassembled when not in use. Further, removable side arms allow the guitar stand to be customized for different instruments or type of guitar (e.g., if a side arm attached at an acute angle is needed versus a different sized or style of side arm).

Side arms 15 can have a length of about 2-15 inches (e.g., at least/no more than about 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, or 15 inches). However, the presently disclosed subject matter is not limited and the side arms can have a length larger or smaller than the range given herein.

Each side arm can have diameter of about 0.1-2 inches. Thus, the side arm can have a diameter of at least about (or no more than about) 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2 inches. However, the presently disclosed subject matter is not limited and the side arms can include a diameter greater or less than the range given above.

In some embodiments, each side arm has about the same length, diameter, and angle 16. However, in some embodiments, the side arms can differ with respect to length, diameter, and/or angle 16, such as to accommodate different types of guitars.

Figure 3D:
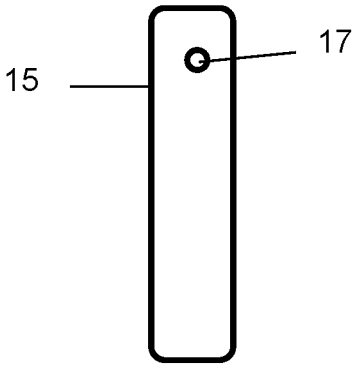
FIGS. 3*d* and 3*e* are side plan views illustrating side arms comprising one or more apertures in accordance with some embodiments of the presently disclosed subject matter.
Figure 3E:
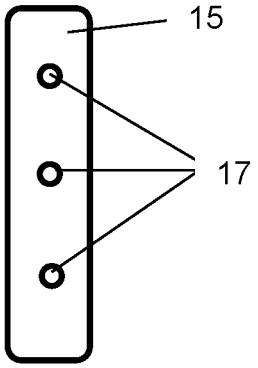

Mount 20 can be attached to each side arm to support a guitar during storage. The term "mount" broadly refers to a mechanical element that can be used to support or hang a device, such as a guitar (e.g., by the guitar headstock). In some embodiments, the mounts are releasably attached to the side arms to allow the user to select a suitable mount depending on a particular instrument type. A mount can be attached to side arm 15 using any known mechanism, such as (but not limited to) the use of screws, bolts, clips, snap-fit arrangement, pressure-fit arrangement, magnets, and the like. For example, side arm 15 can include aperture 17 that allows mount 20 to be screwed or bolted into place as shown in FIG. 3*d*. The aperture can be positioned anywhere on side arm 15, such as in the approximate middle, upper or lower ⅓, upper or lower ¼, upper or lower ⅕, etc. In some embodiments, the side arm can include a plurality of apertures to allow the mount to be customized at a particular location on the side arm, as shown in FIG. 3*e*. In this way, longer or shorter instruments can be accommodated.

Figure 4A:
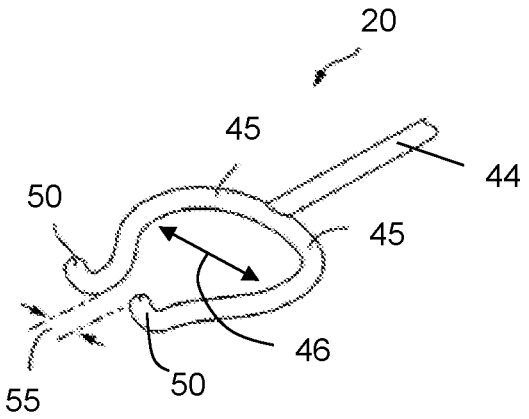
FIG. 4*a* is a perspective view of an instrument mount in accordance with some embodiments of the presently disclosed subject matter.
Figure 4B:
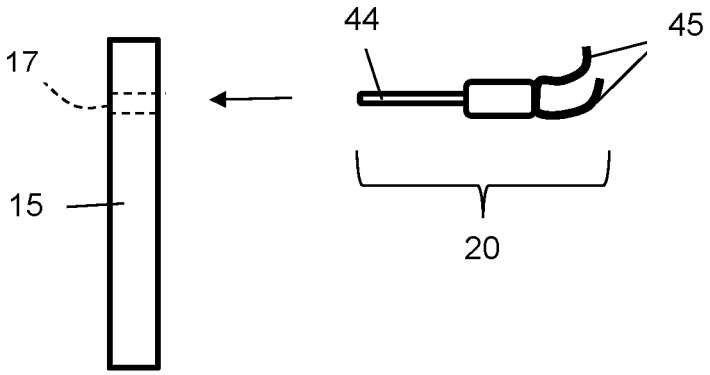
FIGS. 4*b* and 4*c* illustrate one way a mount can be attached to a side arm in accordance with some embodiments of the presently disclosed subject matter.
Figure 4C:
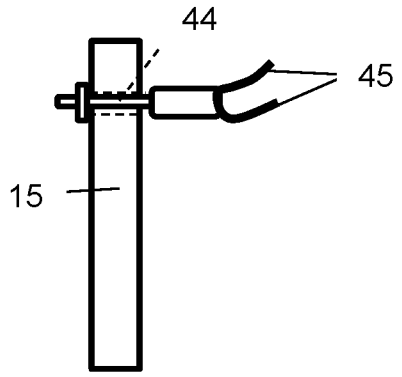

As described above, guitar mount 20 is attached to side arm 15 to support an instrument, such as a guitar. FIG. 4*a* illustrates one embodiment of mount 20 comprising attachment 44 and prongs 45. The attachment allows the mount to be releasably connected to side arm 15. For example, in some embodiments, attachment 44 can pass through side arm aperture 17 and can be bolted or otherwise secured in place, as shown in FIGS. 4*b* and 4*c*. However, the presently disclosed subject matter is not limited and the mount can be permanently or releasably attached to the side arm using any known mechanism. Further, it should be appreciated that any mount can be used and the presently disclosed subject matter is not limited to the mount illustrated in the Figures.

Figure 4D:
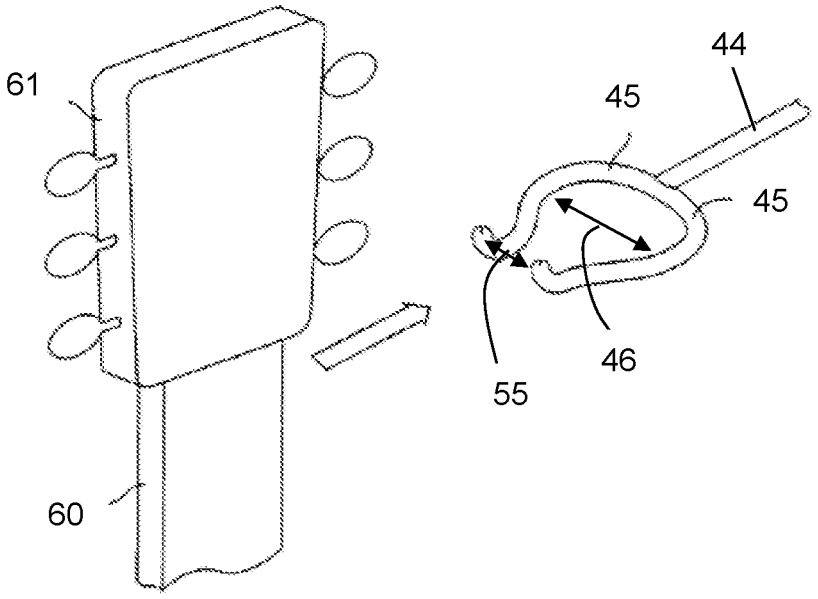
FIGS. 4*d* and 4*e* are perspective views illustrating one way a guitar can be inserted into a mount in accordance with some embodiments of the presently disclosed subject matter.
Figure 4E:
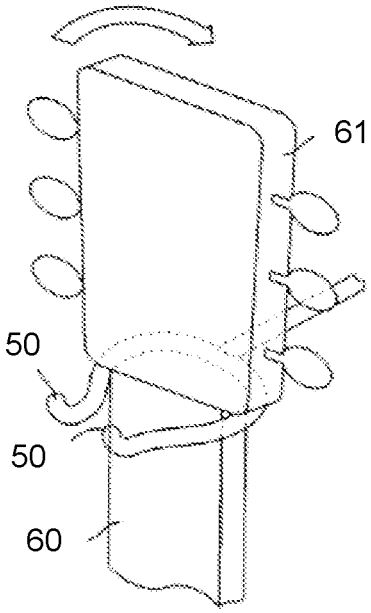
Figure 5A:
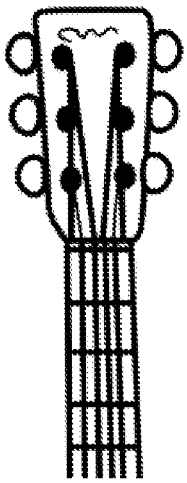
FIGS. 5*a*-5*c* are front plan views illustrating the different ways an instrument can be inserted into a system mount.
Figure 5B:
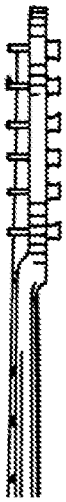
Figure 5C:
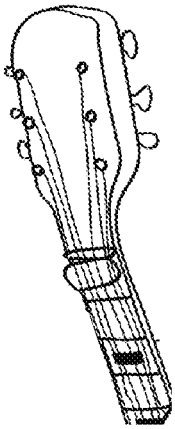

In some embodiments, mount 20 includes a pair of prongs 45 separated by distance 55 that is sufficient to allow guitar neck 60 to pass between the prongs in a first orientation, but not a second orientation, as shown in FIGS. 4*d* and 4*e*. In some embodiment, distance 55 is consistent along the length of the entire prongs. In other embodiments, distance 55 varies. Once the neck has been inserted, the guitar can be rotated (e.g., about 90 degrees) to maintain the guitar within the mount, as shown. The mount also includes internal diameter 46 that is sized to accommodate guitar neck 60, but not headstock 61. Particularly, the internal diameter is large enough to allow the guitar neck to fit therein but is too small to fit the guitar headstock. In this way, the guitar can be hung and supported by the headstock being cradled by prongs 45. The prongs are sized and shaped to retain the headstock of a guitar. It should be appreciated that the description above is only one way to insert an instrument into mount 20. For example, in some embodiments, the guitar can be inserted via the neck from the front, side, or at an angle, as shown in FIGS. 5*a*-5*c*, respectively, and then rotated to the proper storage position.

The guitar neck includes is the portion of an instrument in which cords are created by placing fingers or other objects in specific patterns. The headstock refers to the portion of an instrument (e.g., guitar, lute, mandolin, banjo, ukulele, etc.) that functions to house the pegs or the mechanism that holds the strings at the head of the instrument. The headstock can be either straight or angled (3-25 degrees). The instrument neck is typically narrower than the instrument headstock.

Figure 6A:
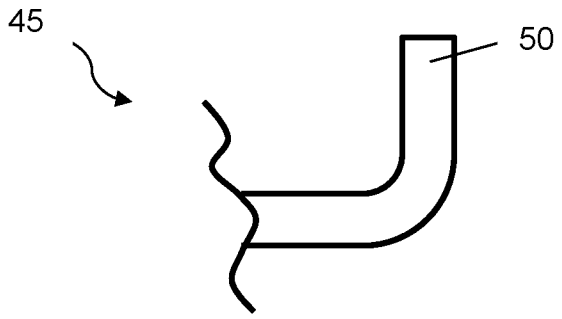
FIGS. 6*a*-6*c* are side plan view of angled mount prongs in accordance with some embodiments of the presently disclosed subject matter.
Figure 6B:
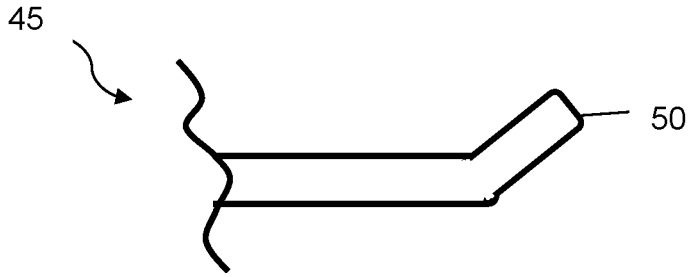
Figure 6C:
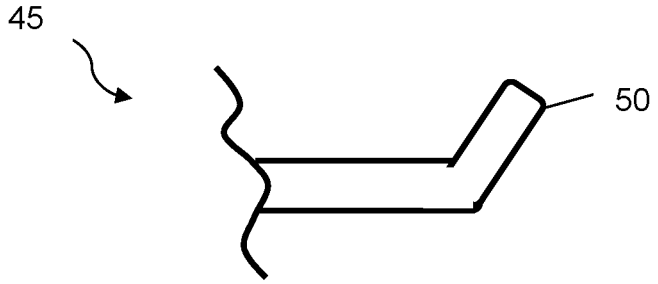
Figure 6D:
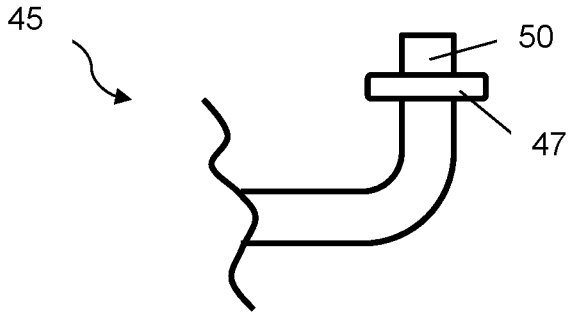
FIG. 6*d* is a side plan view of a mount prong comprising a stopper in accordance with some embodiments of the presently disclosed subject matter.

In some embodiments, distal ends 50 of the prongs are upturned to reduce the likelihood of accidental release from the mount, as shown in FIG. 6*a*. The term "upturned" can include any angle, such as about 90 degrees, 45 degrees, or 60 degrees as shown in FIGS. 6*a*-6*c*, respectively. Further, the distal ends of prongs 45 can include stopper 47 that further ensure that the guitar does not accidentally or inadvertently become dislodged from the mount until desired by the user. The stopper can partially or completely surround one portion of prong 45 as shown in FIG. 6*d*. As would be known in the art, the stopper can be configured in any desired shape, size, and material.

Figure 6E:
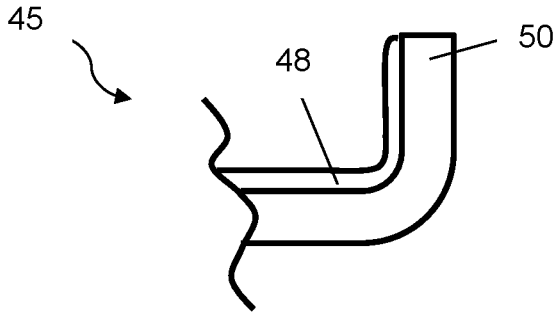
FIG. 6*e* is a side plan view of a mount prong in accordance with some embodiments of the presently disclosed subject matter.

In some embodiments, one or more surfaces of prongs 45 can include padding 48 to cushion the guitar neck and/or headstock. For example, at least a portion of the top surface of the prongs can include padding 48 as shown in FIG. 6*e*. In some embodiments, the entire outer surface of the prongs include padding 48. As with the padding used with the main bar, any cushioned material can be used, such as (but not limited to) foam, elastomeric plastic, fabric, felt, and the like.

Figure 7A:
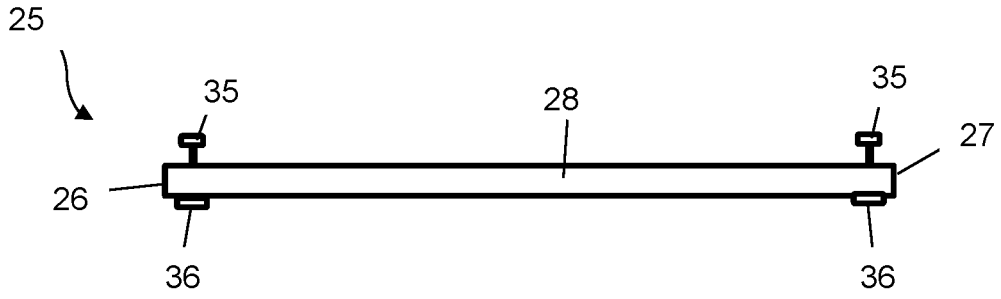
FIG. 7*a* is a top plan view of a support bar in accordance with some embodiments of the presently disclosed subject matter.

Guitar stand 5 also includes support arm 25 that provides for the releasable attachment of a microphone. FIG. 7*a* illustrates one embodiment of support arm 25 comprising first and second ends 26, 27 and main body 28. The support bar can have any desired length, such as about 8-40 inches (e.g., at least/no more than about 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 inches). However, the presently disclosed subject matter is not limited and the support bar can have a length greater or less than the range given herein.

Support bar 25 can further have any desired diameter. For example, the support bar can have a diameter of at least about (or no more than about) 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2 inches. However, the presently disclosed subject matter is not limited and the support bar can include a diameter greater or less than the range given above.

Figure 7B:
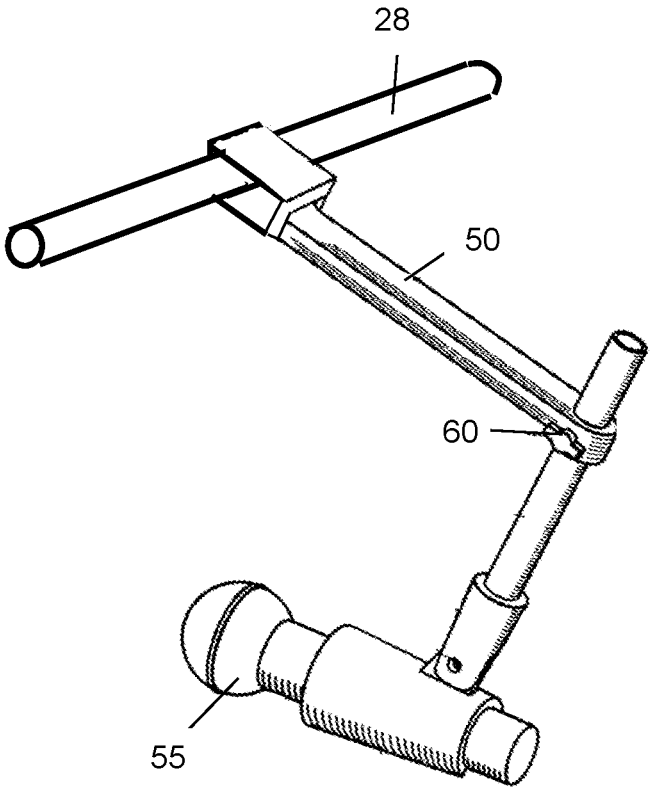
FIG. 7*b* is a perspective view of a microphone assembly attached to a support bar in accordance with some embodiments of the presently disclosed subject matter.

A microphone assembly can be attached to main body 28 of the support bar using any known mechanism. The microphone assembly can include a microphone, attachment to allow the microphone to be attached to the support bar, and/or any associated wiring or other elements. Particularly, microphone holder assembly 50 can be attached at any point along main body 28, depending on user preference as shown in FIG. 7*b*. In this way, a separate microphone stand is not needed. The angle of microphone 55 relative to an associated speaker and the support bar can be adjusted using thumbscrew 60 (or any other mechanism that allows the location and/or angle of the microphone to be adjusted). Those skilled in the art will understand that alternate forms of microphone assembly 50 are possible. For example, in some embodiments, the microphone assembly can include a collar to clasp support bar 25. The collar enables the microphone assembly to move from first to second locations on the support bar, as well as at different angles. In this way, both top speakers can be used for different angles.

Figure 8:
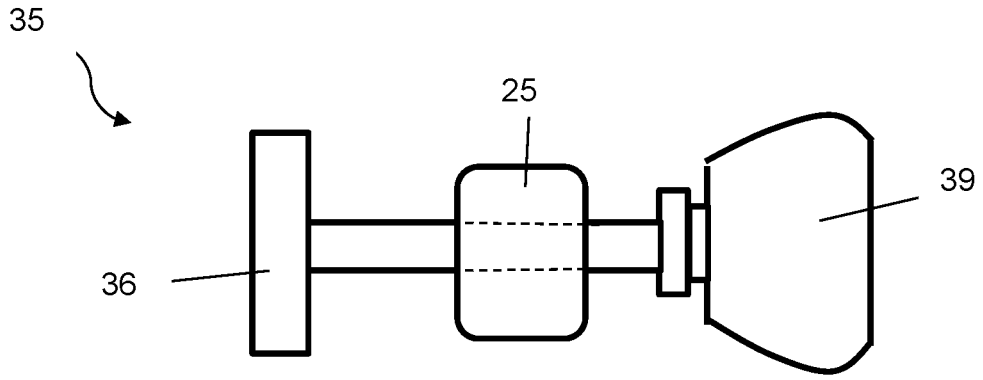
FIG. 8 is a side plan view of a foot assembly in accordance with some embodiments of the presently disclosed subject matter.

The support bar comprises at least one foot assembly 35 to lock the system in proper position. One embodiment of a foot assembly is shown in FIG. 8. Particularly, foot assembly 35 can comprise foot 39 to secure the stand under the lip of a support, such as a speaker cabinet. In some embodiments, foot 39 can be a swivel foot. The term "swivel foot" refers to a foot that can be lengthened and/or angled as desired by the user. In some embodiments, the swivel foot can be rotatably coupled to the knob. However, any known type of foot can be used. The length and/or angle of the foot can be adjusted using any known mechanism, such as knob 36 that can be turned as desired by the user to advance and/or angle the foot. In some embodiments, the knob can pass through the support bar to connect with the foot.

Foot assembly 35 can be constructed from any desired material. For example, in some embodiments, at least a portion of the foot can be constructed from rubber, foam, and the like to ensure that the foot does not damage the speaker or speaker cabinet. In some embodiments, at least a portion of the foot can include a textured or gripping feature to help maintain the foot in a desired position.

Figure 9A:
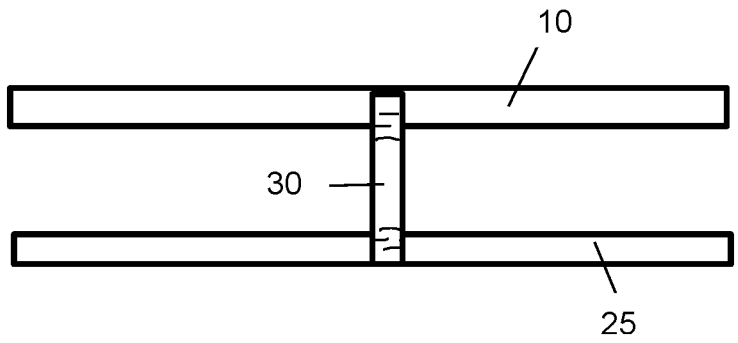
FIG. 9*a* is a front plan view of a main bar connected to a support bar in accordance with some embodiments of the presently disclosed subject matter.
Figure 9B:
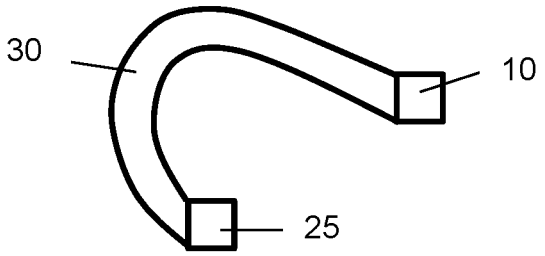
FIG. 9*b* is a side plan view of a main bar connected to a support bar in accordance with some embodiments of the presently disclosed subject matter.

Support bar 25 can be operably connected to main bar 10 using any known mechanism. For example, in some embodiments, at least one connector 30 can be used to attach the support bar to the main bar. The term "connector" broadly refers to any element that can permanently or releasably join two elements. One embodiment of connector 30 is illustrated in FIGS. 9*a* and 9*b*. As shown, the connector is curved to accommodate the lip of a support (such as a speaker), allowing main bar 10 to rest on a top surface, while the support bar fits under the top lip of the support, as discussed in more detail below.

In some embodiments, the disclosed mounting system (e.g., main bar 10, support bar 25, connector 30, side arms 15, and/or mounts 20) can be constructed from one or more rigid or semi-rigid materials. The term "rigid material" refers to a material that is inflexible. The term "semi-rigid" refers to a material that exhibits an amount of flexibility such that it can deform from its original shape without cracking or breaking. Suitable rigid and semi-rigid materials can include (but are not limited to) metal, wood, plastic, stone, or combinations thereof. For example, in some embodiments, steel or stainless steel can be used.

In some embodiments, at least one component of system 5 can be hollow to provide a lightweight characteristic to the system. However, the presently disclosed subject matter also includes embodiments where the one or more components are formed from a solid portion of material.

Main bar 10, support bar 25, connector 30, side arms 15, and mounts 20 can have any desired cross-sectional shape, such as (but not limited to) oval, round, square, rectangular, triangular, pentagonal, hexagonal, octagonal, star-shaped, abstract, and the like. In some embodiments, each component of system 5 can have the same cross-sectional shape. However, the presently disclosed subject matter is not limited and at least one component can have a different cross-sectional shape when compared to at least one other component.

System 5 can be formed as a single unitary piece (main bar 10, support bar 25, connector 30, side arms 15, and/or mounts 20) using standard techniques, such as casting, welding, thermoforming, and the like. Alternatively, one or more components of the system can be separately formed and then releasably or permanently attached together.

Figure 10A:
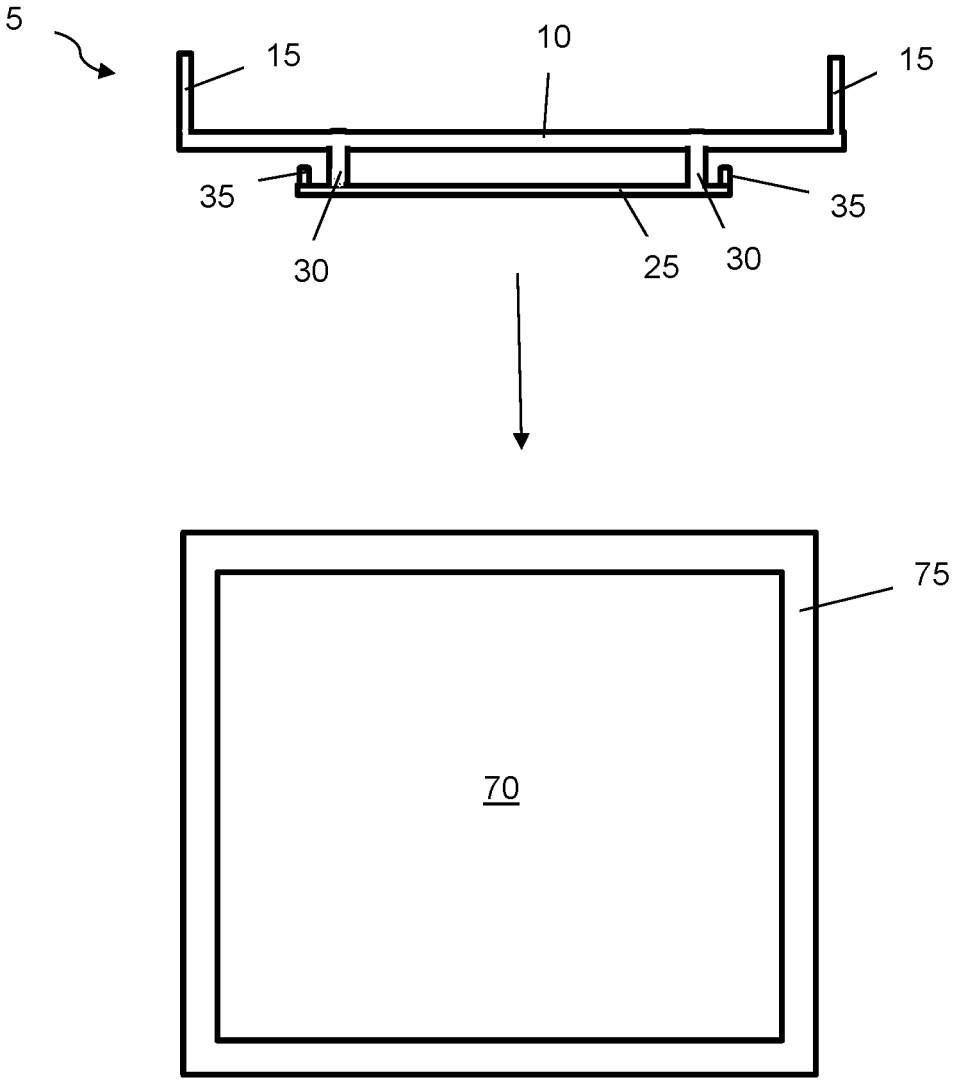
FIGS. 10*a* and 10*b* are front plan views of a mounting system positioned on a support device in accordance with some embodiments of the presently disclosed subject matter.
Figure 10B:
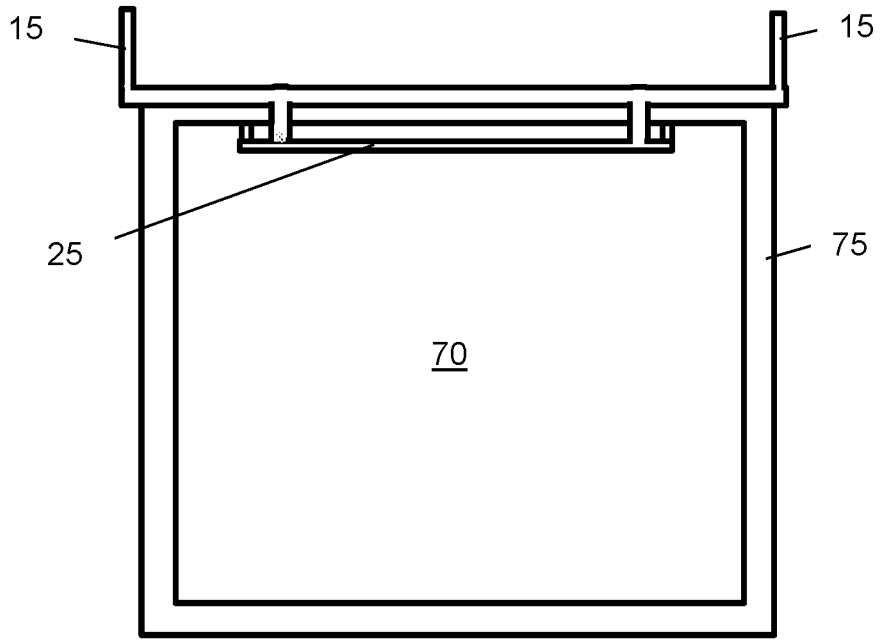
Figure 10C:
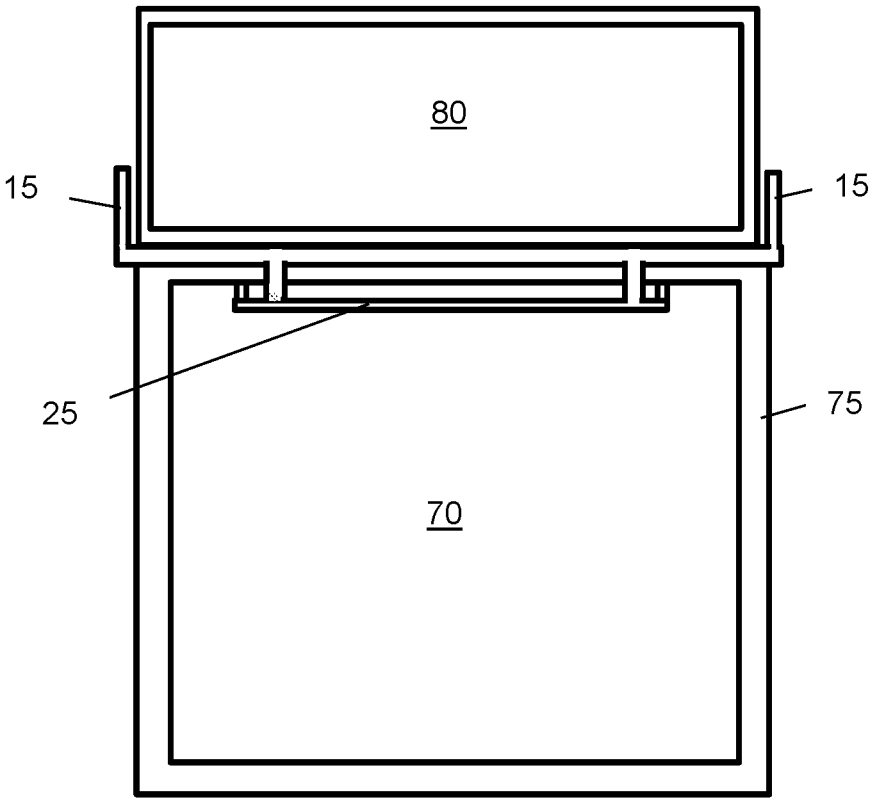
FIG. 10*c* is a front plan view of a mounting system used with an amplifier in accordance with some embodiments of the presently disclosed subject matter.

System 5 can be used to support two instruments (e.g., two guitars) on either side of a support, such as an amplifier and/or a speaker. The term "amplifier" refers to an element that makes the signal of an electric instrument louder that it will produce sound through a speaker. The term "speaker" refers to an electroacoustic device connected to a component in an audio system to make speech or music audible. In use, system main bar 10 is positioned on the top surface of speaker cabinet 75 such that connectors 30 extend in front of the speaker and support bar 25 is held adjacent to the top lip of the speaker cabinet, as shown in FIGS. 10*a* and 10*b*. Amplifier 80 can then be positioned to sit on top of main support 10, thereby adding weight to the device to further resist movement, as shown in FIG. 10*c*. It should be appreciated that the speaker and amplifier illustrated in the figures are merely representative examples of support elements, not intended to be limiting.

Figure 10D:
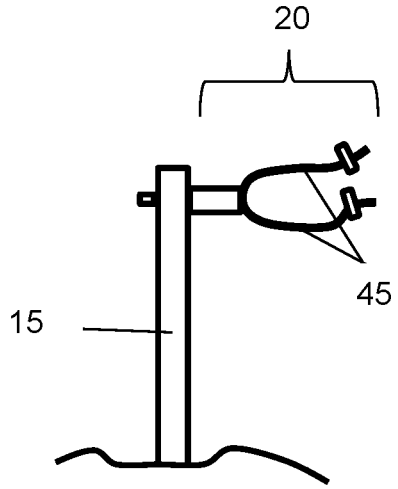
FIG. 10*d* is a side plan view of an instrument mount in accordance with some embodiments of the presently disclosed subject matter.
Figure 10E:
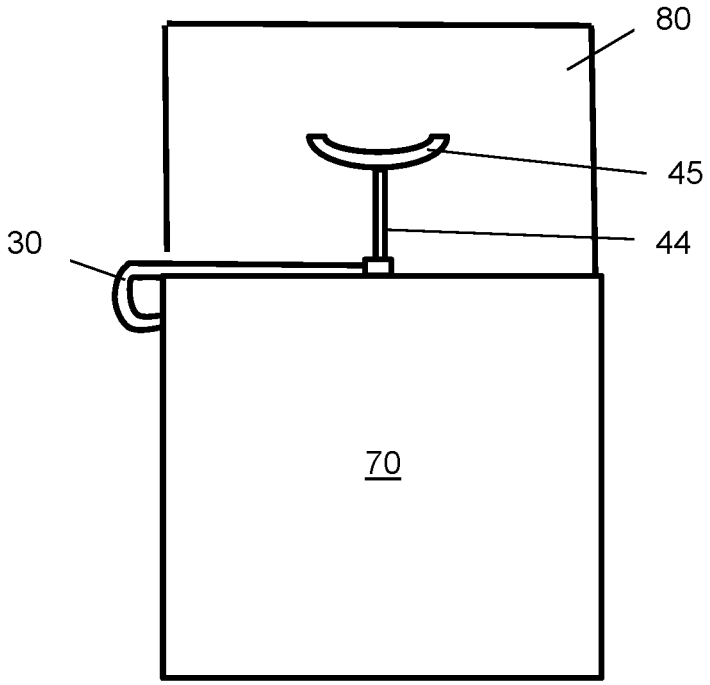
FIG. 10*e* is a side plan view of a mounting system assembled on a speaker cabinet in accordance with some embodiments of the presently disclosed subject matter.

Either before or after the amplifier is positioned on top of main support 10, mounts 20 can be added to side arms 15, as shown in FIGS. 10*d* and 10*e*. A mount can be screwed into each support arm, or removably or permanently attached using any known mechanism. As described above, each mount supports an instrument. For example, each mount can support the headstock of a corresponding guitar to securely hold the guitar in place. Further, each mount can be selected by the user according to the particular instrument to be stored.

Figure 10F:
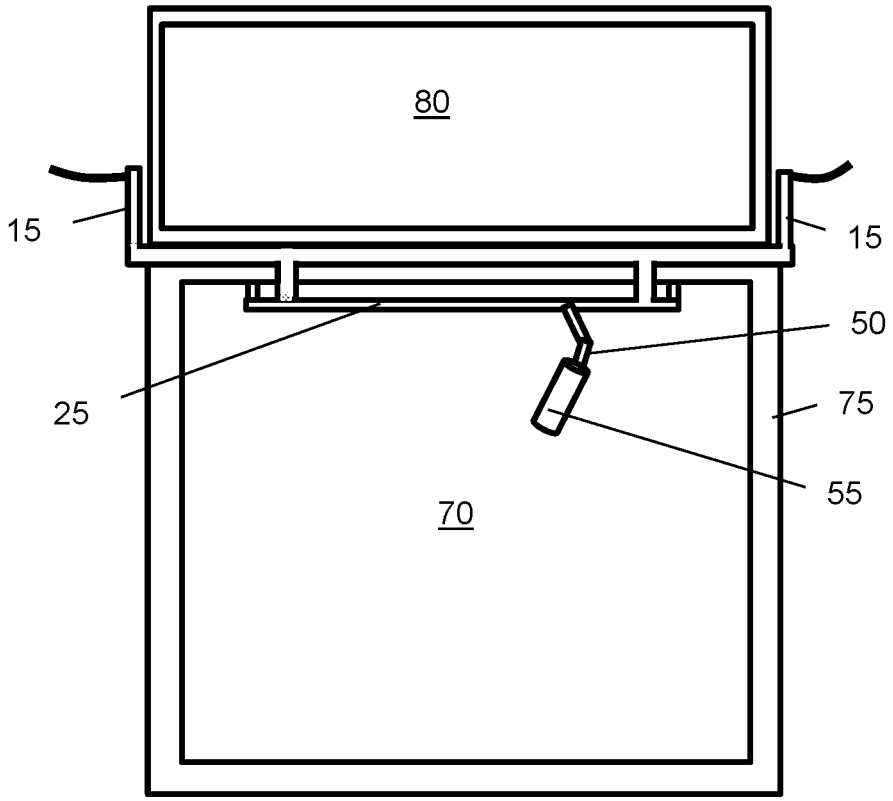
FIG. 10*f* is a front plan view of a mounting system with an attached microphone assembly.

Optionally, a microphone assembly can be attached to connector 25, as shown in FIG. 10*f*. As would be known in the art, the microphone assembly can be attached to support bar 25 using any mechanism (e.g., clamping, clipping, screws, bolts, clips, hook and loop closure, magnets, and the like). In some embodiments, the microphone portion of the assembly can be angled toward the speaker output to amplify the music.

Figure 11A:
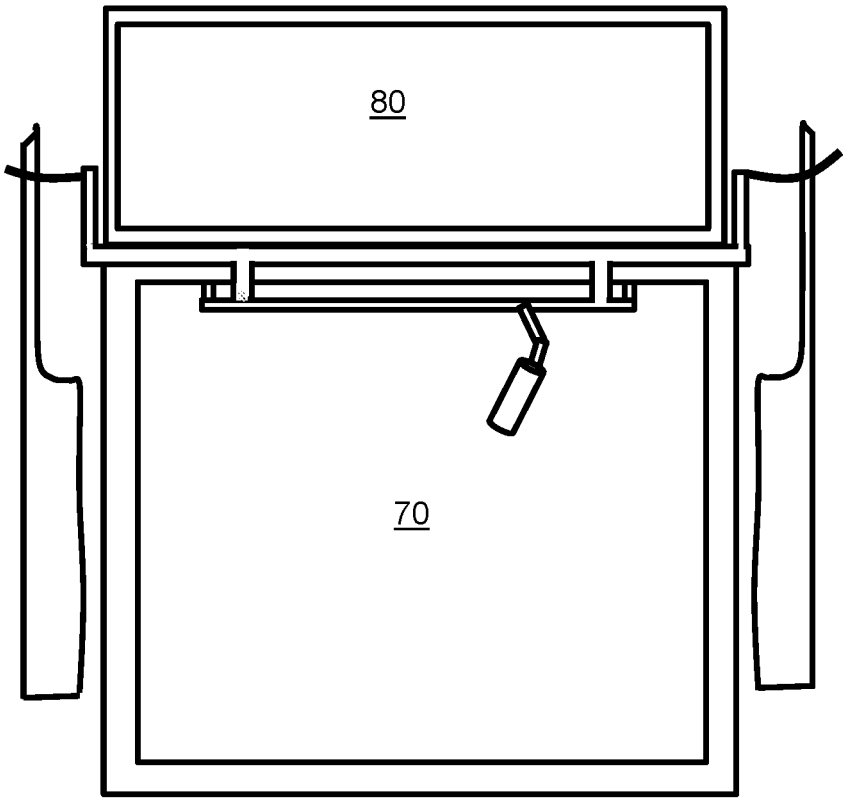
FIG. 11*a* is a front plan view of a mounting system with a pair of attached guitars.
Figure 11B:
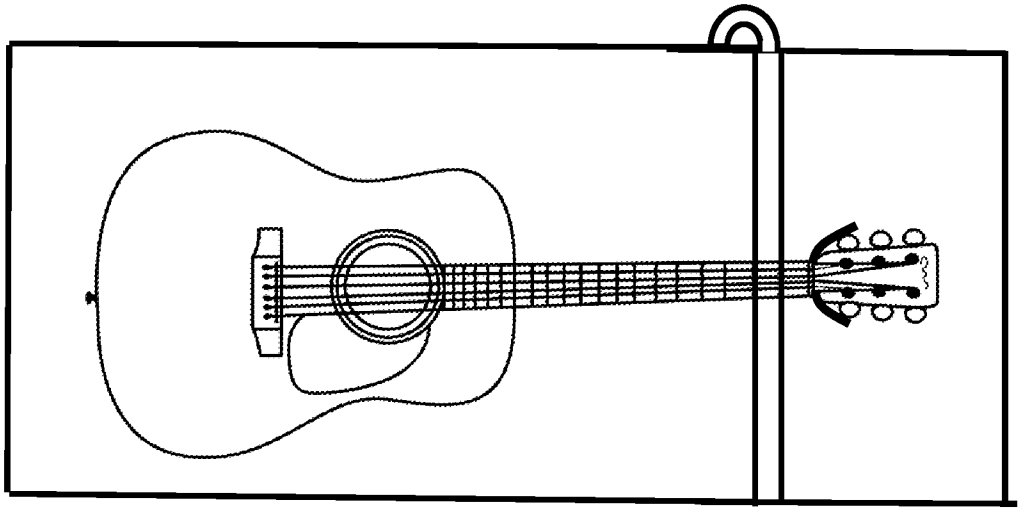
FIG. 11*b* is a side plan view of a mounting system with an attached guitar.

Once mounts 20 have been attached, a guitar can be maintained on both sides of the speaker and/or amplifier arrangement as described above. The mounts support the guitar by resting the headstock in prongs 50. As shown in FIGS. 11*a* and 11*b*, the guitars can be suspended above the floor, reducing the amount of floorspace required to store a guitar on stage. Alternatively, in some embodiments, the lower portion of the instrument can contact the floor. In addition, the disclosed system uses the weight of amplifier 80 (or any other element positioned on top of the main bar) to counter the weight of a guitar placed in the mount, thereby increasing stability. It should be appreciated that a single guitar can be securely held by system 5 on either side without tipping over, even when no amplifier is in place. Specifically, foot assembly 35 of the support bar functions to grip and hold the system in proper position by gripping the lip of the speaker cabinet. One or two guitars (or other elements) can therefore be securely attached to the stand and are not easily dislodged. However, the guitars can be easily and quickly removed when needed.

Figure 12A:
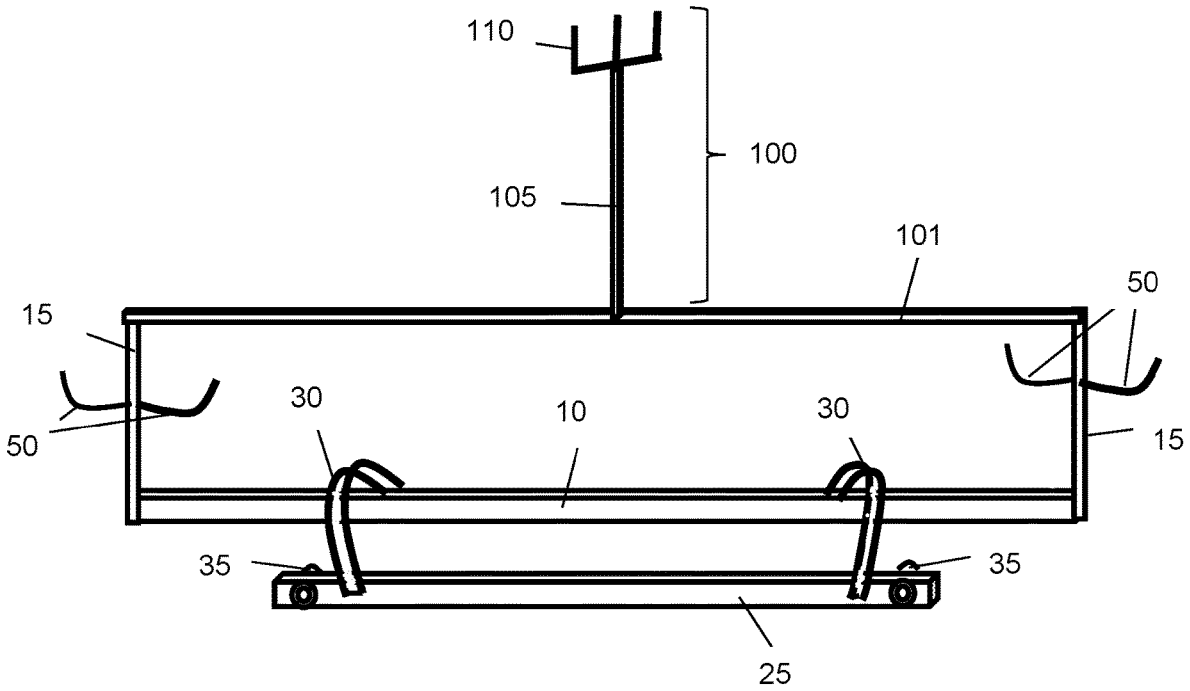
FIG. 12*a* is an alternate embodiment of a mounting system in accordance with some embodiments of the presently disclosed subject matter.

FIG. 12*a* illustrates one embodiment of an alternative design comprising extension 100 that can be used to secure two guitars in an "X" pattern on one face of a larger-sized support (e.g., amplifier or speaker). As shown, mounts 20 can be secured to the front face of side arms 15 to support the bottom of a guitar as described below. In some embodiments, each mount can include a pair of prongs 50 in any desired shape. The top portion of each side arm 15 is attached to extension bar 101 that supports extension 100.

The extension bar can have any desired length, such as about 10-20 inches (e.g., at least/no more than about 10, 11, 12, 13, 14, 15, 16, 17, 18, 19, or 20 inches). However, the presently disclosed subject matter is not limited and the extension bar can have a length greater or less than the range given herein.

Extension bar 101 can further have any desired diameter, such as at least about (or no more than about) 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.05, 1.1, 1.15, 1.2, 1.25, 1.3, 1.35, 1.4, 1.45, 1.5, 1.55, 1.6, 1.65, 1.7, 1.75, 1.8, 1.85, 1.9, 1.95, or 2 inches. However, the presently disclosed subject matter is not limited and the extension bar can include a diameter greater or less than the range given above.

In some embodiments, the extension bar can be configured to have about the same size and/or shape as main bar 10. However, the presently disclosed subject matter is not limited. In some embodiments, the extension bar can be arranged about parallel with main bar 10 and/or support bar 25.

Extension 100 is permanently or releasably attached to extension bar 101 using any known method, such as welding, snap-fit arrangement, pressure fit arrangement, the use of mechanical elements (e.g., screws, bolts, clips), magnets, adhesive, and the like. The extension can be positioned perpendicularly relative to extension bar 101. Alternatively, the extension can be angled in one direction.

The extension includes leg 105 that is used to elevate rest 110 to a desired height to accommodate one or two instruments (e.g., guitars). Leg 105 can have any desired length, such as about 5-20 inches (e.g., at least/no more than about 5, 6, 7, 8, 9, 10, 11, 12, 13, 14, 15, 16, 17, 18, 19, or 20 inches). However, the length of the leg is not limited and can be greater than or less than the range given.

Figure 12B:
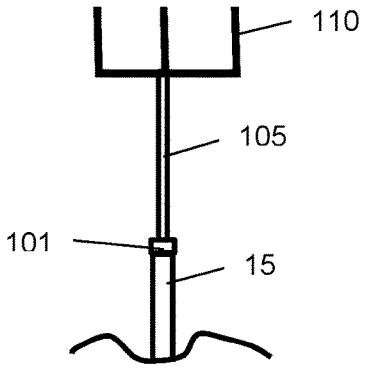
FIG. 12*b* is a fragmentary view of an extension rest and leg in accordance with some embodiments of the presently disclosed subject matter.
Figure 12C:
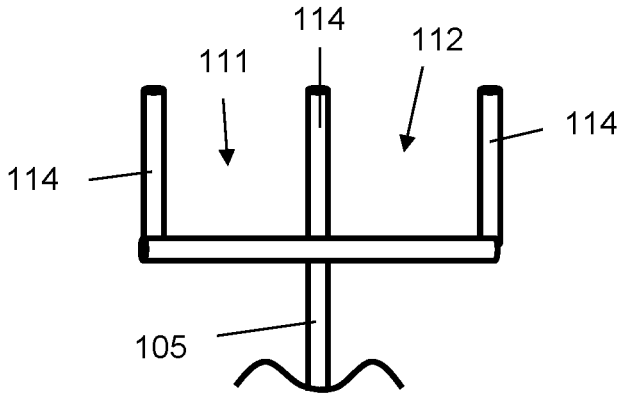
FIG. 12*c* is a perspective view of an instrument rest in accordance with some embodiments of the presently disclosed subject matter.
Figure 12D:
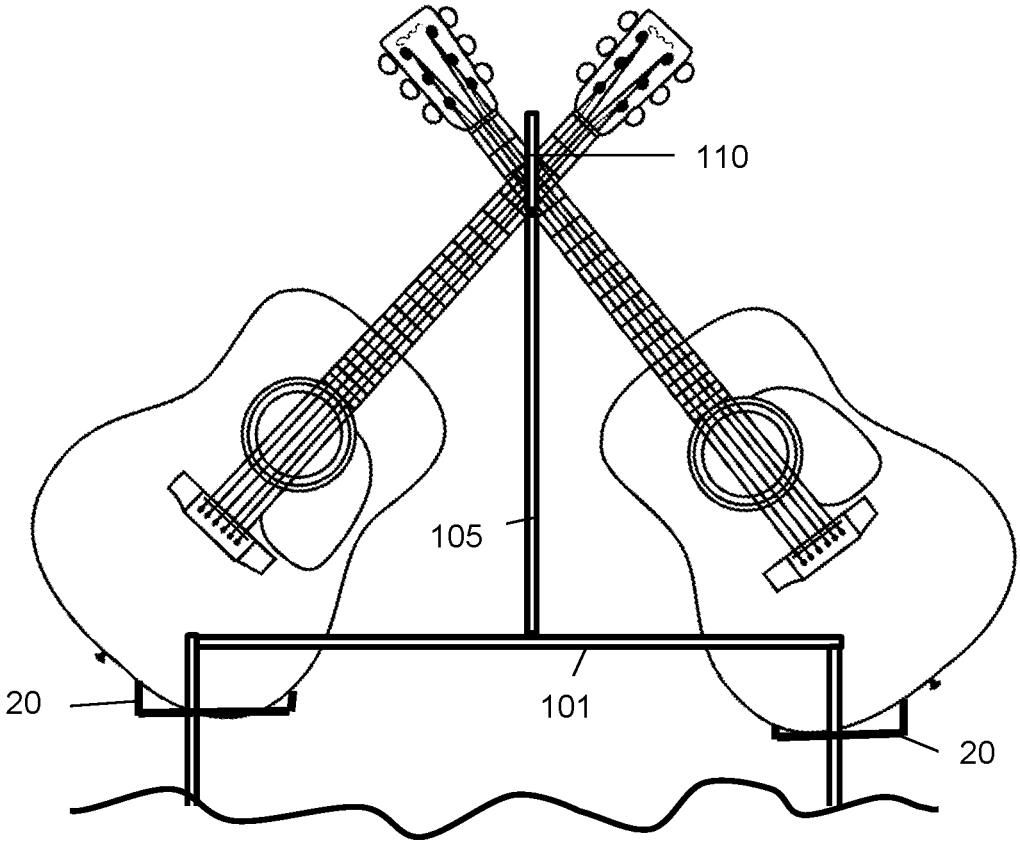
FIG. 12*d* is a front plan view of an instrument stand extension in use.

Rest 110 is configured to support the necks of two guitars arranged in an "X" orientation, as described below. The rest can have a sideways "E" or "W" shape, as shown in the side plan view of FIG. 12*b*. As shown in FIG. 12*c*, rest 110 comprises three tines 114 that create recesses 111, 112. Recess 111 houses the neck of a first guitar, while recess 112 houses the neck of a second guitar, as shown in FIG. 12*d*.

It should be appreciated that guitars and other musical instruments vary in size. Accordingly, the dimensions of stand 5 can be varied to correspond to the size of the particular guitar that is to be held. To this end, the length of one or more elements of system 5 can be adjustable (e.g., the length of the main bar, support bar, side arm, prong, extension bar, leg, rest). Any length adjusting element can be used, such as (but not limited to) a pivot locking system, telescoping arrangement, insertion and removal of extenders, or mixing and matching various elements of the system. In this way, the system can be customized to accommodate any size or type of guitar.

System 5 provides many advantages over prior art mounting systems. Specifically, the disclosed device provides safe storage for one or two instruments (e.g., guitars) on either side of a support (e.g., an amplifier, a half stack amplifier, a stereo, a stereo cabinet, etc.). The term "instrument" broadly includes musical instruments as well as any other item that can be stored using system 5.

Because the guitars are maintained on the sides of the amplifier, valuable stage space is freed up compared to storing guitars on guitar stands in the middle of the stage.

Further, because the guitars are securely stored away from the main stage, there is a reduced likelihood that the guitars will be knocked over and/or damaged.

System 5 is also strong, lightweight and can be easily installed and removed as desired by the user.

In addition, the disclosed system can be customized by the user, depending on the type of mounts, arms, bars, etc. best suited for a particular instrument.

The system also enables a user to isolate a suitable microphone locking placement consistently, which can further be used on other attachments (e.g., lights).

The disclosed mounting system effectively converts three stands into one (e.g., two guitar stands and one microphone stand).

System 5 is compact and is capable of holding a guitar adjacent to an amplifier and/or speaker without damage to the guitar or other equipment.

System 5 enables the instruments to be suspended by the headstock, ensuring that the guitars are kept in tune. In comparison, prior art guitar stands commonly exert leaning pressure on the guitar neck, compromising tuning of the guitar.

The foregoing descriptions have been presented for purposes of illustration and description and are not intended to be exhaustive or to limit the presently disclosed subject matter. Many modifications and variations are possible in light of the present disclosure.

What is claimed is:

1. A musical instrument mounting system comprising:

an elongate main bar comprising a first end and a second end, wherein the main bar is configured to rest directly upon a top surface of a support;

a vertically extending first side arm attached to the first end of the main bar and a vertically extending second side arm attached to the second end of the main bar, wherein a pair of upturned prongs extend outwardly from each side arm respectively to secure a musical instrument;

an elongate support bar comprising a first end and a second end;

at least one arcuate connector comprising a proximal end and a distal end, wherein the proximal end of the at least one connector is fixed to the main bar and the distal end of the at least one connector is fixed to the support bar to operatively attach the support bar to the main bar;

a foot assembly positioned at each end of the support bar, wherein each foot assembly comprises a gripping foot that is configured to engage an underside of a lip of the support to secure the main bar in place.

2. The mounting system of claim 1, further comprising a microphone assembly releasably attached to the support bar.

3. The mounting system of claim 1, wherein the musical instrument is selected from an acoustic guitar, bass guitar, electric guitar, banjo, mandolin, violin, cello, viola, or combinations thereof.

4. The mounting system of claim 1, wherein each pair of prongs is configured to secure each musical instrument by a headstock of each musical instrument respectively.

5. The mounting system of claim 1, wherein the main bar and the support bar are about parallel relative to each other.

6. The mounting system of claim 1, wherein a bottom surface of the main bar comprises a padding.

7. The mounting system of claim 1, wherein each side arm can be attached to the main bar at any angle desired by a user.

8. The mounting system of claim 1, wherein each side arm includes at least one aperture.

9. The mounting system of claim 1, wherein each pair of prongs comprises an internal diameter that is sized to accommodate a guitar neck but not a guitar headstock of each musical instrument.

10. The mounting system of claim 1, wherein each gripping foot comprises a swivel foot with an adjustable angle, position, length, or combinations thereof.

11. A method of mounting a musical instrument, the method comprising the steps of:

positioning the main bar of the musical instrument mounting system of claim 1 on a top surface of a first support;

engaging each gripping foot with an underside of a lip of the first support;

positioning a second support on a top surface of the main bar, such that the main bar is positioned in between the first and second supports;

removably attaching at least one musical instrument comprising a neck and headstock to a corresponding first pair of prongs, wherein the headstock of the at least one musical instrument is cradled by the corresponding first pair of prongs.

12. The method of claim 11, wherein the first support is a speaker cabinet.

13. The method of claim 11, wherein the second support is an amplifier.

14. The method of claim 11, further comprising the steps of releasably attaching a microphone assembly to the first support bar.

15. The method of claim 11, wherein the at least one musical instrument is selected from a group comprising an acoustic guitar, a bass guitar, an electric guitar, a banjo, a mandolin, a violin, a cello, a viola, or combinations thereof.

16. The method of claim 11, wherein the main bar and the support bar are about parallel relative to each other.

17. The method of claim 11, wherein a bottom surface of the main bar comprises padding.

18. The method of claim 11, wherein each pair of prongs comprises an internal diameter that is sized to accommodate a neck of the at least one musical instrument but not a headstock of the at least one musical instrument.

19. The method of claim 11, wherein each gripping foot comprises a swivel foot with an adjustable angle, position, length, or combinations thereof.

* * * * *